US012623808B2

(12) United States Patent
Greene et al.

(10) Patent No.: US 12,623,808 B2
(45) Date of Patent: May 12, 2026

(54) CONSUMER PRODUCT PACKAGE

(71) Applicant: The Gillette Company LLC, Boston, MA (US)

(72) Inventors: Jeffrey Allen Greene, Milton, MA (US); Matthew James Helle, Cambridge, MA (US); Angel Nafarrete Barrozo, Medford, MA (US); Andrew Martin Joseph Gauvin, Pittsford, NY (US)

(73) Assignee: The Gillette Company LLC, Boston, MA (US)

( * ) Notice: Subject to any disclaimer, the term of this patent is extended or adjusted under 35 U.S.C. 154(b) by 246 days.

(21) Appl. No.: 17/508,391

(22) Filed: Oct. 22, 2021

(65) Prior Publication Data

US 2023/0129219 A1 Apr. 27, 2023

(51) Int. Cl.
*B65D 5/02* (2006.01)
*B65D 5/42* (2006.01)

(52) U.S. Cl.
CPC ..... *B65D 5/0227* (2013.01); *B65D 5/4208* (2013.01)

(58) Field of Classification Search
CPC .. B65D 5/4208; B65D 5/0227; B65D 5/0281; B65D 5/4225; B65D 5/4279
USPC ..... 229/117.18, 941; 206/806, 459.5, 831
See application file for complete search history.

(56) References Cited

U.S. PATENT DOCUMENTS 1,577,556 A 3/1926 Samuel et al.
1,616,677 A 2/1927 Samuel
1,956,642 A 5/1934 Einson
1,969,428 A 8/1934 Samuel
2,406,301 A * 8/1946 Lively ..... B65D 5/0227 229/87.08
2,659,524 A * 11/1953 Mcelwee ..... B65D 71/0003 229/117.14
2,833,457 A 5/1958 Tyrseck
(Continued)

FOREIGN PATENT DOCUMENTS

DE 9109326 U1 10/1991
DE 9305418 U1 8/1993
(Continued)

OTHER PUBLICATIONS

All Office Actions; U.S. Appl. No. 17/112,516, filed Dec. 4, 2020.
(Continued)

*Primary Examiner* — Nathan J Newhouse
(74) *Attorney, Agent, or Firm* — John M. Lipchitz

(57) ABSTRACT

A consumer product package with a front panel having an upper portion with a top surface folded over a top surface of a lower portion of the front panel. A rear panel is parallel to the front panel. A top panel extends between the front panel and the rear panel. A bottom panel extends between the front panel and the rear panel. A first side panel extends between the front panel and the rear panel transverse to the top panel and the bottom panel. A second side panel extends between the front panel and the rear panel transverse to the top panel and the bottom panel. The front panel, the rear panel, the top panel, the bottom panel, the first side panel and the second side panel form a cavity configured to receive a consumer product. An edge of the upper portion of the front panel extends into the cavity.

5 Claims, 14 Drawing Sheets

(56) References Cited

U.S. PATENT DOCUMENTS

| | | | | | |
|---|---|---|---|---|---|
| 2,874,870 | A | | 2/1959 | Collura | |
| 2,900,124 | A | | 8/1959 | Leone | |
| 2,933,232 | A | | 4/1960 | Aldo | |
| 3,074,614 | A | | 1/1963 | Moffat | |
| 3,394,863 | A | | 7/1968 | Wood et al. | |
| 3,591,070 | A | | 7/1971 | Vrana | |
| 3,625,411 | A | * | 12/1971 | Cote | B65D 5/4208 206/316.1 |
| 3,799,332 | A | | 3/1974 | Jeronimus | |
| 3,934,791 | A | * | 1/1976 | Dick | B65D 5/0227 229/134 |
| 3,946,936 | A | * | 3/1976 | Brown | B65D 5/4208 229/117.18 |
| 4,207,978 | A | | 6/1980 | Patterson et al. | |
| 4,279,376 | A | * | 7/1981 | Roccaforte | B65D 5/4208 229/117.22 |
| 4,291,807 | A | * | 9/1981 | Giordano | B65D 5/5435 229/152 |
| 4,308,986 | A | * | 1/1982 | Parrilli | B65D 5/20 229/122 |
| 4,344,533 | A | * | 8/1982 | Olsen | B65D 5/5435 229/117.18 |
| 4,413,730 | A | | 11/1983 | Morse | |
| 4,447,004 | A | | 5/1984 | House et al. | |
| 4,468,212 | A | | 8/1984 | Jennings | |
| 4,948,036 | A | | 8/1990 | Loughman | |
| 4,949,845 | A | * | 8/1990 | Dixon | B65D 5/5435 229/212 |
| 5,117,973 | A | | 6/1992 | Lo | |
| 5,263,586 | A | | 11/1993 | Keable | |
| 5,341,923 | A | * | 8/1994 | Arasim | B65D 5/4229 206/214 |
| 5,363,981 | A | | 11/1994 | Giblin et al. | |
| 5,474,183 | A | * | 12/1995 | Warren | B65D 5/4208 206/459.5 |
| 5,713,472 | A | | 2/1998 | Howell et al. | |
| 6,598,746 | B2 | * | 7/2003 | Lux, Jr. | B65D 5/445 206/778 |
| 7,731,039 | B1 | | 6/2010 | Minger et al. | |
| 7,789,233 | B2 | * | 9/2010 | Levy | B65D 5/4208 206/459.5 |
| 8,066,178 | B2 | * | 11/2011 | Sorrentino | B65D 5/2076 229/162.1 |
| 8,424,276 | B2 | * | 4/2013 | Krause | B65D 71/36 53/49 |
| 8,881,903 | B2 | * | 11/2014 | Vulgamott | B65D 5/4229 40/310 |
| 11,414,235 | B2 | | 8/2022 | Greene et al. | |
| 2003/0178335 | A1 | * | 9/2003 | Ichikawa | B65D 77/0413 206/391 |
| 2008/0272011 | A1 | | 11/2008 | Levy et al. | |
| 2012/0012489 | A1 | | 1/2012 | Mongan et al. | |
| 2013/0075462 | A1 | | 3/2013 | Jones et al. | |
| 2014/0319201 | A1 | * | 10/2014 | Begim | B65D 5/4208 493/55 |

FOREIGN PATENT DOCUMENTS

| | | | |
|---|---|---|---|
| DE | 69300386 | T2 | 4/1996 |
| EP | 1109730 | A1 | 6/2001 |
| KR | 100885978 | B1 | 3/2009 |

OTHER PUBLICATIONS

PCT Search Report and Written Opinion for PCT/US2022/078340 dated Jan. 12, 2023, 12 pages.

* cited by examiner

CONSUMER PRODUCT PACKAGE

FIELD OF THE INVENTION

The present invention relates to packages for consumer products and more particularly, to foldable consumer product packages.

BACKGROUND OF THE INVENTION

Consumer products are incorporating more innovation to provide consumers with improved user experiences. However, innovative consumer products are more expensive and thus are more likely to be stolen at the retail shelf by shoplifters. Shoplifters typically look for products that are compact, relatively expensive and can be sold for near-retail prices. For example, razors and razor blade cartridges are typically expensive, small in size, have a high resale value and are in high demand, especially for more premium brands. Similar to razors and razor blades, electric toothbrushes and their corresponding replacement heads are also commonly shoplifted items. Teeth whitening strips are another dental hygiene product with a high theft rate in retail stores. Furthermore, with the advancement of e-commerce the shoplifting industry is growing because of the increased ease of selling of stolen products over the internet.

Consumer product companies and retailers typically used plastic blister packages because they are more difficult for shoplifters to tear open. However, due to mounting global concerns about the environment, it has become desired for producers to adopt eco-friendly packaging. Plastic packages also frustrate legitimate consumers because of the difficulty of opening the package without the aid of a sharp tool. Accordingly, more packages are being designed with paper based materials. However, paper based packages are easier to rip open, especially when anti-theft tags are attached to the hang tag portion of the package. Despite the use of known packaging techniques, there remains a need to further modify consumer product packages to hamper product theft while also providing a more sustainable package.

SUMMARY OF THE INVENTION

In one aspect, the invention features, in general, a consumer product package with a front panel having an upper portion with a top surface folded over a top surface of a lower portion of the front panel. A rear panel is parallel to the front panel. A top panel extends between the front panel and the rear panel. A bottom panel extends between the front panel and the rear panel. A first side panel extends between the front panel and the rear panel and transverse to the top panel and the bottom panel. A second side panel extends between the front panel and the rear panel and transverse to the top panel and the bottom panel. The front panel, the rear panel, the top panel, the bottom panel, the first side panel and the second side panel form a cavity configured to receive a consumer product. An edge of the upper portion of the front panel extends into the cavity.

In another aspect, the invention features, in general, a sheet of formable material for a consumer product package. A front panel at a first end has an upper portion with a top surface folded over a top surface of a lower portion of the front panel. A first side support panel extends from the lower portion of the front panel. A second side support panel extends from the lower portion of the front panel. An edge at the first end of the upper portion is positioned between the first side support panel and the second side support panel.

In another aspect, the invention features, in general, a consumer product package with a front panel, a rear panel parallel to the front panel, a top panel extending between the front panel and the rear panel. A first upper minor tab extends from the top panel. A bottom panel extends between the front panel and the rear panel. A first lower minor tab extends from the bottom panel. The first upper minor tab and the first lower minor tab have a folded position with an end of the first upper minor tab facing an end of the first lower minor tab. A first side support panel has a folded position over the first upper minor tab and first lower minor tab. A first side panel has a folded position over the first side support panel. The first side panel is directly bonded to the first minor tab, the first lower minor tab and the first side support panel.

DETAILED DESCRIPTION OF THE INVENTION

Figure 1A:
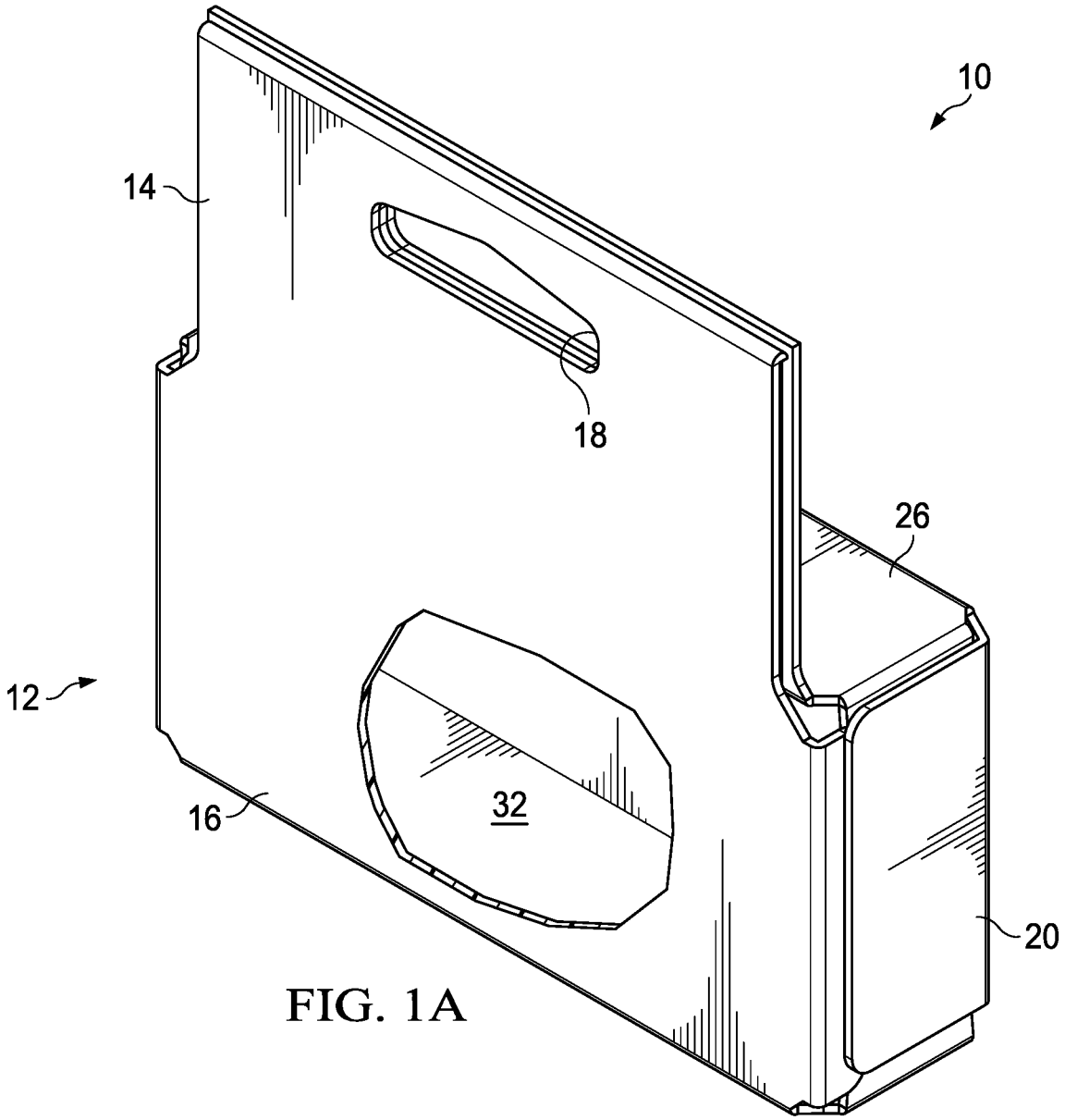
FIG. 1A is a front perspective view of one possible embodiment of consumer product package.
Figure 1B:
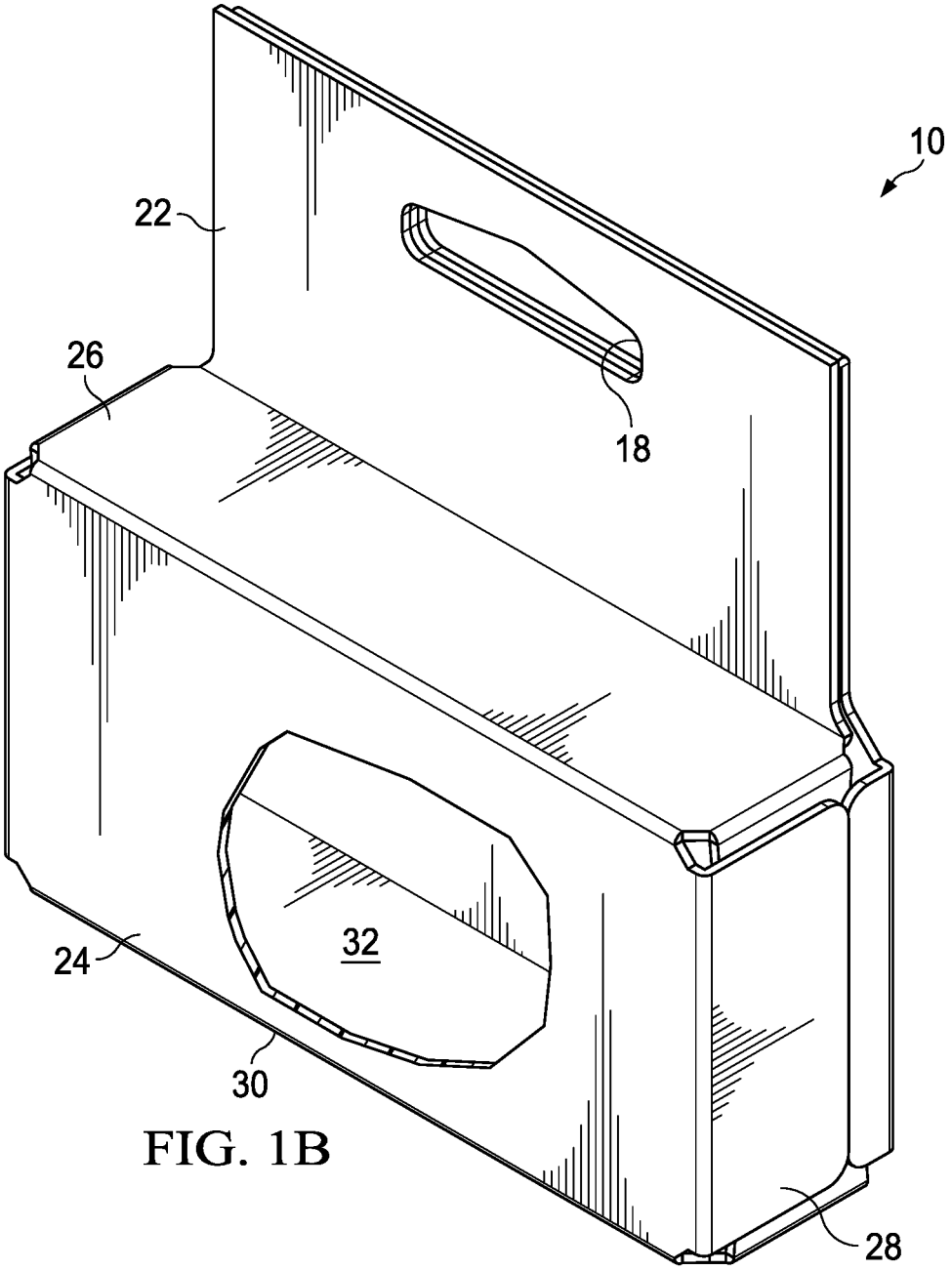
FIG. 1B is a rear perspective view of the consumer product package of FIG. 1A.

Referring to FIGS. 1A and 1B, one possible embodiment of the present invention is shown illustrating a front and rear perspective views of a consumer product package 10. As will be explained in greater detail below, the consumer product package 10 may be folded from a sheet of formable material to create a box-like shape to contain one or more consumer products. As shown in FIG. 1A, the consumer product package 10 may have a front panel 12 with an upper portion 14 and a lower portion 16. In certain embodiments, artwork and/or branding may be applied to the front panel 12. The consumer product package 10 may define an opening 18 dimensioned to receive a retail peg (not shown) or a security tag (not shown). The hang tag opening 18 can be any shape, such as a circle, oval, triangle or rectangle. Although the opening 18 is illustrated as a bounded opening, the opening 18 may be unbounded (e.g., a "J" or hook shape configuration). A first side panel 20 may extend in a transverse direction from the front panel 12 (e.g., the lower portion 16 of the front panel 12).

The consumer product package 10 may include a support panel 22 opposing the front panel 12. A rear panel 24 (FIG. 1B) may extend parallel to and oppose the front panel 12 (e.g., the lower portion 16 of the front panel 12). A top panel 26 may extend in a transverse direction between the support panel 22 and the rear panel 24. The support panel 22 may reinforce (e.g., sealed against) the front panel 12 to provide improved rigidity and tear resistance. The top panel 26 may also extend in a transverse direction between the rear panel 24 and the front panel 12. A second side panel 28 may extend in a parallel direction to the first side panel 20. The first side panel 20 and the second side panel 28 may extend between the front panel 12 and the rear panel 24. The first side panel 20 and the second side panel 28 may also extend between the top panel 26 and a bottom panel 30. The first side panel 20 and the second side panel 28 may be transverse to the top panel 26, the bottom panel 30, the front panel 12 and the rear panel 24 to define a generally rectangular shaped box having a cavity 32 dimensioned to receive one or more consumer products (not shown).

Artwork, such as, branding, graphics or consumer product information may be applied to one or more of the panels of the consumer product package 10. The artwork, branding or graphics may be printed directly on one or more of the panels (e.g., the rear panel 24 or the front panel 12) or a sticker may be applied to one or more of the panels that contains artwork. Furthermore, it is understood that the consumer product package 10 may be displayed at shelf within a store or digitally in any configuration. For example, the artwork, branding or graphics may be positioned on the front panel 12 and product information may be displayed on the rear panel 24, or vice versa. It is understood the consumer product package 10 may be displayed at a retailer in any configuration and the way the consumer product package 10 is displayed does do not affect the functionality of the consumer product package 10.

Figure 2:
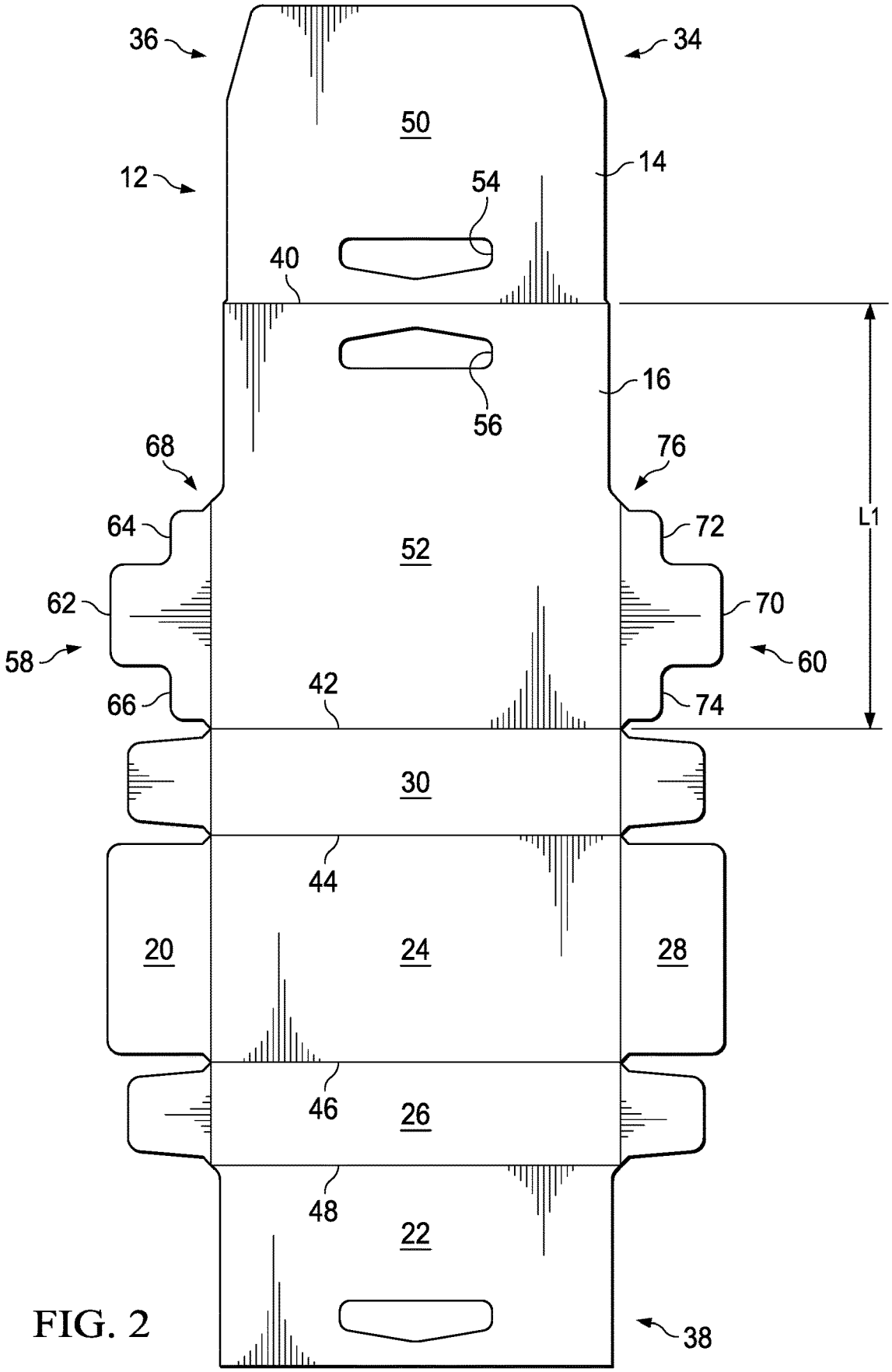
FIG. 2 top view of a sheet of formable material.

Referring to FIG. 2, a top view of a sheet of formable material 34 is shown in an unfolded position. In certain embodiments, the sheet of formable material 34 may have a thickness of about 0.3 mm to about 0.7 mm. The sheet of formable material 34 may be die cut from a single sheet of material. The sheet of formable material 34 may comprise paperboard, containerboard, and or paper bags. The sheet of formable material 34 may also include one or more cellulose-based products such as cardboard, paperboard, paper sheet, bamboo and other sustainable, compostable, biodegradable or recycled/recyclable materials. The sheet of formable material 34 may have one or more surfaces that are coated and/or have printed graphics. However, it is understood graphics may be applied at any step of the process. For example, labels may be applied to the consumer product package 10 (FIGS. 1A and 1B) in lieu of or in addition two graphics printed directly on the sheet of formable material 34. The sheet of formable material 34 may be folded, glued or otherwise secured into a final folded position resulting in the consumer product package 10, as shown in FIGS. 1A and 1B. In certain embodiments, the folding and gluing may be completed in multiple steps. For example, a first supplier may cut the sheet of formable material 34 and apply glue and fold certain portions before sending it to another location for final folding assembly location where the product is inserted into the consumer product package 10 (FIGS. 1A and 1B) added. Alternatively, all the steps may be completed as part of a single operation.

The sheet of formable material 34 may have a first end 36 and an opposing second end 38. The upper portion 14 of the front panel 12 may be at the first end 36. The support panel 22 may be at the second end 38. The upper portion 14 and the lower portion 16 may be separated by a fold line 40. It is understood that fold lines may include numerous different manufacturing options to make the assembly process easier. When forming and folding a carton, the folding steps may be facilitated by providing fold lines such as, crease lines, cut lines, perforations, partial cuts, slit scores, pre-break, or a combination of these. The term fold line is used as a general description of any of these techniques which may be used to facilitate accurate folding along a predetermined path. There may also be a fold line 42 between the lower portion 16 of the front panel 12 and the bottom panel 30. The lower portion 16 may have a length "L1" extending from the fold line 40 to the fold line 42. In certain embodiments, the length "L1" may be about 50 mm to about 100 mm. However, the length "L1" may vary depending on the size of the consumer product package 10 (FIGS. 1A and 1B). The length "L1" may represent the length of the lower portion 16. In certain embodiments, the length "L1" may also represent the length of the front panel 12 of the consumer product package 10 (i.e., in a final folded position) from the bottom panel 30 to the outer edge 106 (FIG. 5D).

The first side panel 20 and the second side panel 28 may extend outwardly from the rear panel 24. The rear panel 24 may be positioned between the bottom panel 30 and the top panel 26. There may be a fold line 44 between the rear panel 24 and the bottom panel 30. The top panel 26 may be positioned between the support panel 22 and the rear panel 24. A fold line 46 may be between the rear panel 24 and the top panel 26. There may also be a fold line 48 between the support panel 22 and the top panel 26.

The upper portion 14 of the front panel 12 may have a top surface 50 and the lower portion 16 of the front panel may have a top surface 52. The upper portion 14 may define an opening 54 and the lower portion 16 may define an opening 56. The fold line 40 may be positioned between the opening 54 and the opening 56. The openings 54 and 56 may be of a similar size and geometry.

A first side support panel 58 and a second side support panel 60 may extend outward from the lower portion 16 in opposite directions. The first side support panel 58 may have a central portion 62 that extends out between a pair of lateral portions 64 and 66. In certain embodiments, a first chamfer 68 may extend between the first side support panel 58 (e.g., lateral portion 64) and the lower portion 16. For example, the first chamfer 68 may be formed by a first angle and a second angle or otherwise could be a curve or an arc with no straight angles. The second side support panel 60 may have a central portion 70 that extends out between a pair of lateral portions 72 and 74. In certain embodiments, a second chamfer 76 may extend between the second side support panel 60 (e.g., lateral portion 72) and the lower portion 16. For example, the second chamfer 76 may be formed by a first angle and a second angle or otherwise could be a curve or an arc with no straight angles. The first chamfer 68 may avoid a 90 degree or near 90 degree angle between the lateral side portion 64 and the lower portion 16, to minimize point force loading in the event a thief tries to rip the consumer product package 10 open. The second chamfer 76 may avoid a 90 degree or near 90 degree angle between the lateral side portion 76 and the lower portion 16, to minimize point force loading in the event a thief tries to rip the consumer product package 10 open. It is understood the chamfers 68 and 76 may not form sharp angles, but may have fillet or radius.

Figure 3A:
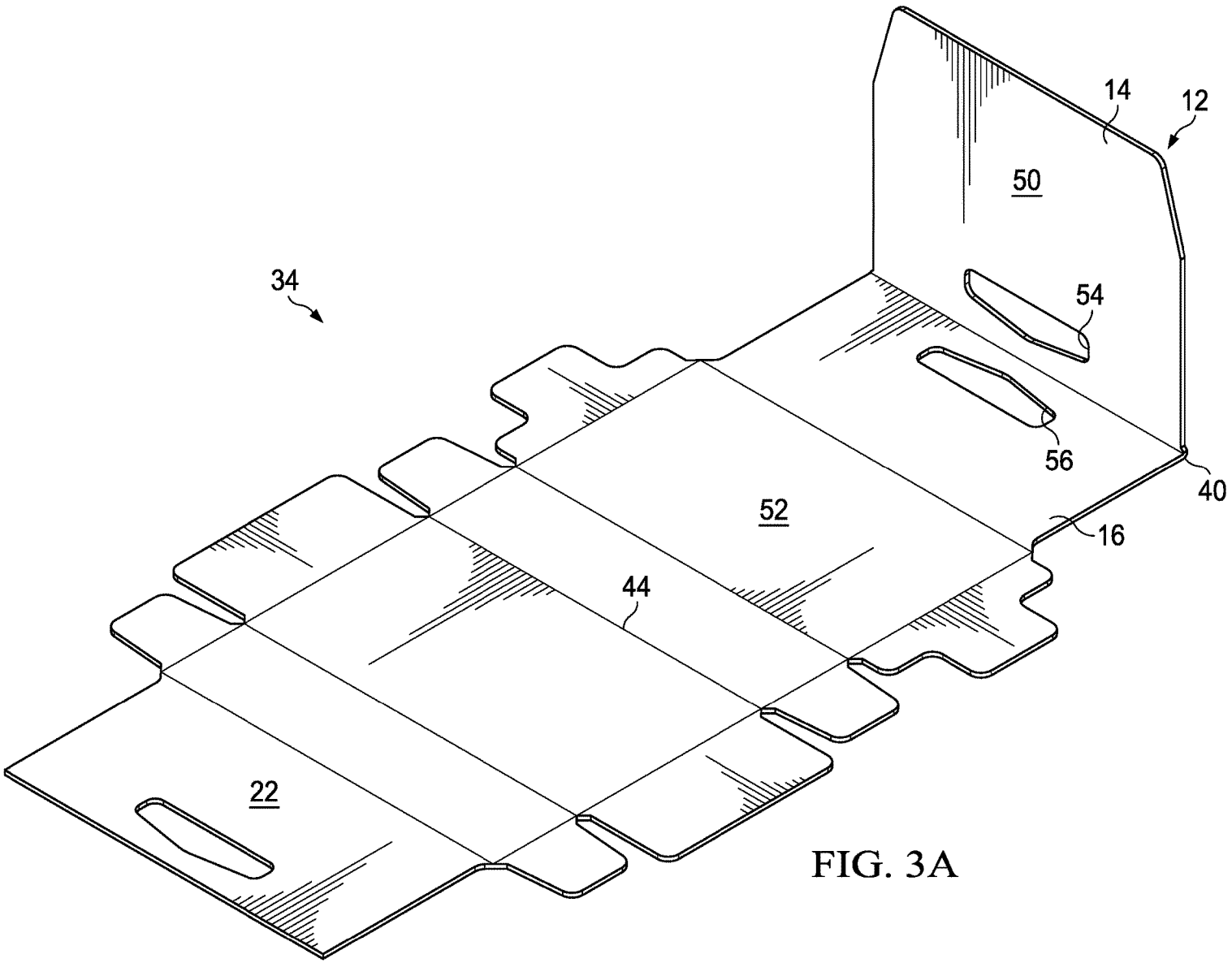
FIG. 3A is perspective view of the sheet of formable material in a folded position.
Figure 3B:
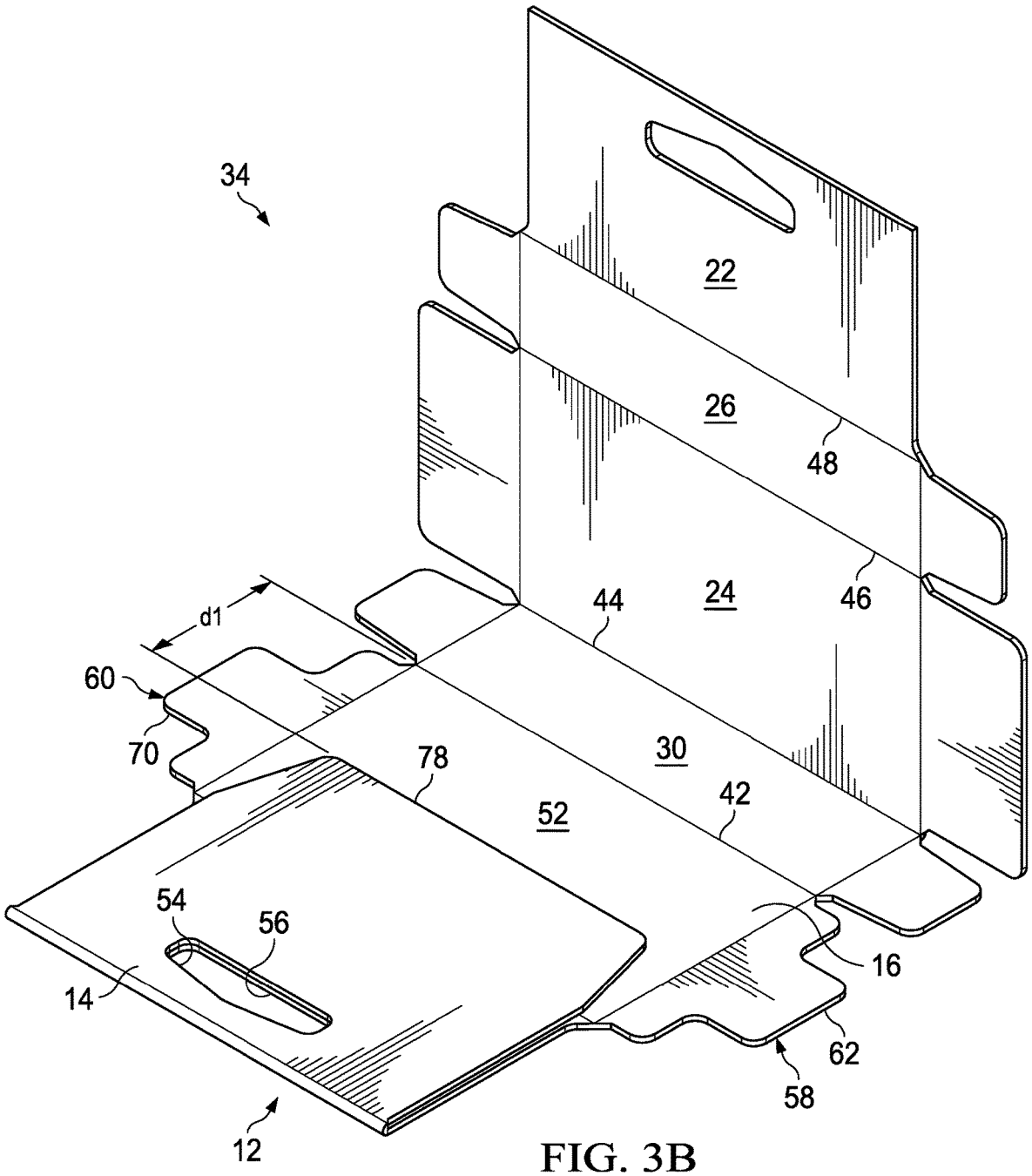
FIG. 3B is perspective view of the sheet of formable material in a folded position.
Figure 3C:
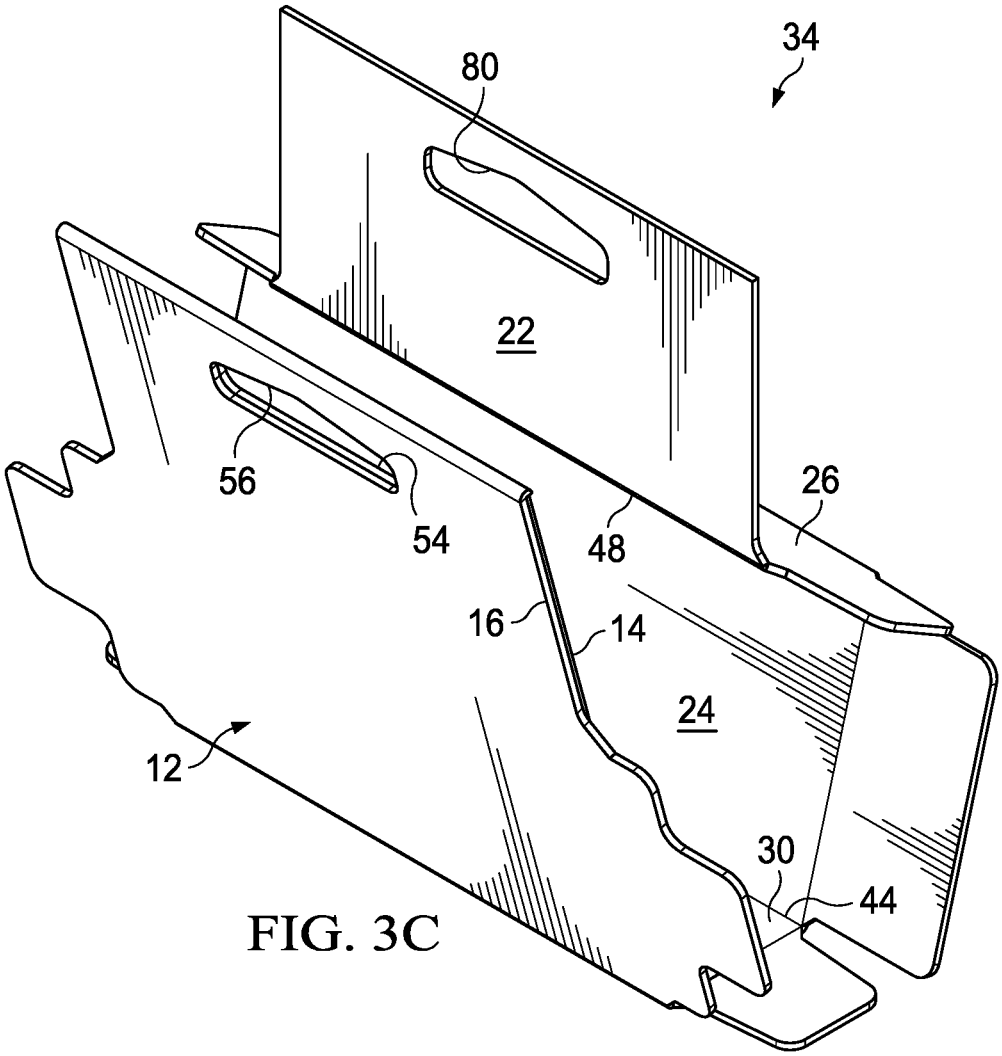
FIG. 3C is front perspective view of the sheet of formable material in a folded position.

Referring to FIGS. 3A, 3B and 3C perspective views of the sheet of formable material 34 is shown, illustrating the folding of the front panel 12 and the support panel 22. As shown in FIG. 3A, the fold line 40 may facilitate the upper portion 14 being folded over the lower portion 16. The upper portion 14 may be folded such that the top surface 50 contacts the top surface 52 of the lower portion 16 (FIG. 3B). In certain embodiments, the top surfaces 50 and 52 may be bonded together, for example, with adhesive. In a folded position, the opening 54 of the upper portion 14 may be aligned with the opening 56 of the lower portion 16 (FIG. 3B) to create a more robust structure for attachment of a security tag (not shown).

Referring to FIG. 3B, a perspective view of the sheet of formable material 34 is shown, illustrating the upper portion 14 folded on top of the lower portion 16. The upper portion 14 may be folded so it overlaps the lower portion 16, which increases the tear strength of the consumer product package 10. This provides improved integrity throughout the overlapping panels. Most notably the improved integrity may be at the intersection of the upper portion 14 and the lower portion 16 since this is where a tear may tend to propagate in the situation where a thief grips the consumer product package 10 and attempts rip open the consumer product package. In the folded position, an edge 78 of the upper portion 14 may be positioned between the first side support panel 58 and the second side support panel 60 to provide improved rigidity and tear resistance of the consumer product package 10 (FIGS. 1A and 1B). The edge 78 may extend between the central portions 62 and 70 of the respective first side support panel 58 and the second side support panel 60. However, it is understood that the edge 78 may be positioned beyond the central portions 62 and 70 and up to the fold line 42. In certain embodiments, a distance "d1" from the edge 78 of the upper portion 14 of the front panel 12 to the fold line 42 (e.g., the bottom panel 30) may be at least 20% of L1 (FIG. 2). Accordingly, the edge 78 may extend into the cavity 32 (FIG. 1A) to help increase the rigidity of the consumer product package 10 (FIG. 1A).

As shown in FIGS. 3B and 3C, the fold line 44 may facilitate the folding of the rear panel 24 toward the front panel 12 (e.g., top surface 52 of the front panel 12). For example, the rear panel 24 may form an approximate right angle to the bottom panel 30 in a folded position. The fold line 42 may facilitate the folding of the front panel 12 toward the rear panel 24. For example, the front panel 12 may form an approximate right angle to the bottom panel 30 in a folded position (FIG. 1A). The fold line 46 may facilitate the folding of the top panel 26 so it is transverse to the rear panel 24 in a final folded position, as shown in FIG. 1B. The fold line 48 may facilitate the folding of the support panel 22 so it is transverse to the top panel 26, as shown in FIG. 3C. The upper portion 14 being folded over the lower portion 16 creates a two-ply reinforced structure, which may be further strengthened by the support panel 22. The support panel 22 may be folded toward the front panel 12 (FIG. 3C) so the support panel 22 directly contacts the front panel 12 and an opening 80 defined by the support panel 22 aligns with the openings 54 and 56 of the front panel 12 to form the reinforced opening 18 of the consumer product package 10 shown in FIGS. 1A and 1B. The front panel 12 (e.g., the upper portion 14) may be sealed to the support panel 22 to further improve tear resistance. The rear panel 24 may be spaced apart from the front panel 12 in the folded position with the front panel 12 sealed against the support panel 22.

Referring to FIGS. 4A, 4B, 4C and 4D, a perspective view of the sheet of formable material 34 is shown illustrating various folding steps to form the consumer product package 10 of FIGS. 1A and 1B. The overlapping of the openings 54, 56 and 80 of FIG. 3C, may result in the opening 18. The opening 18 may be defined by (i.e., extend through) the front panel 12 (the upper portion 14 and the lower portion 16 shown in FIG. 2) and the support panel 22. Accordingly, the opening 18 may be reinforced by stacking three layers of formable material. In certain embodiments, the upper portion 14 may be positioned between and directly bonded to the lower portion 16 and the support panel 22.

Figure 4A:
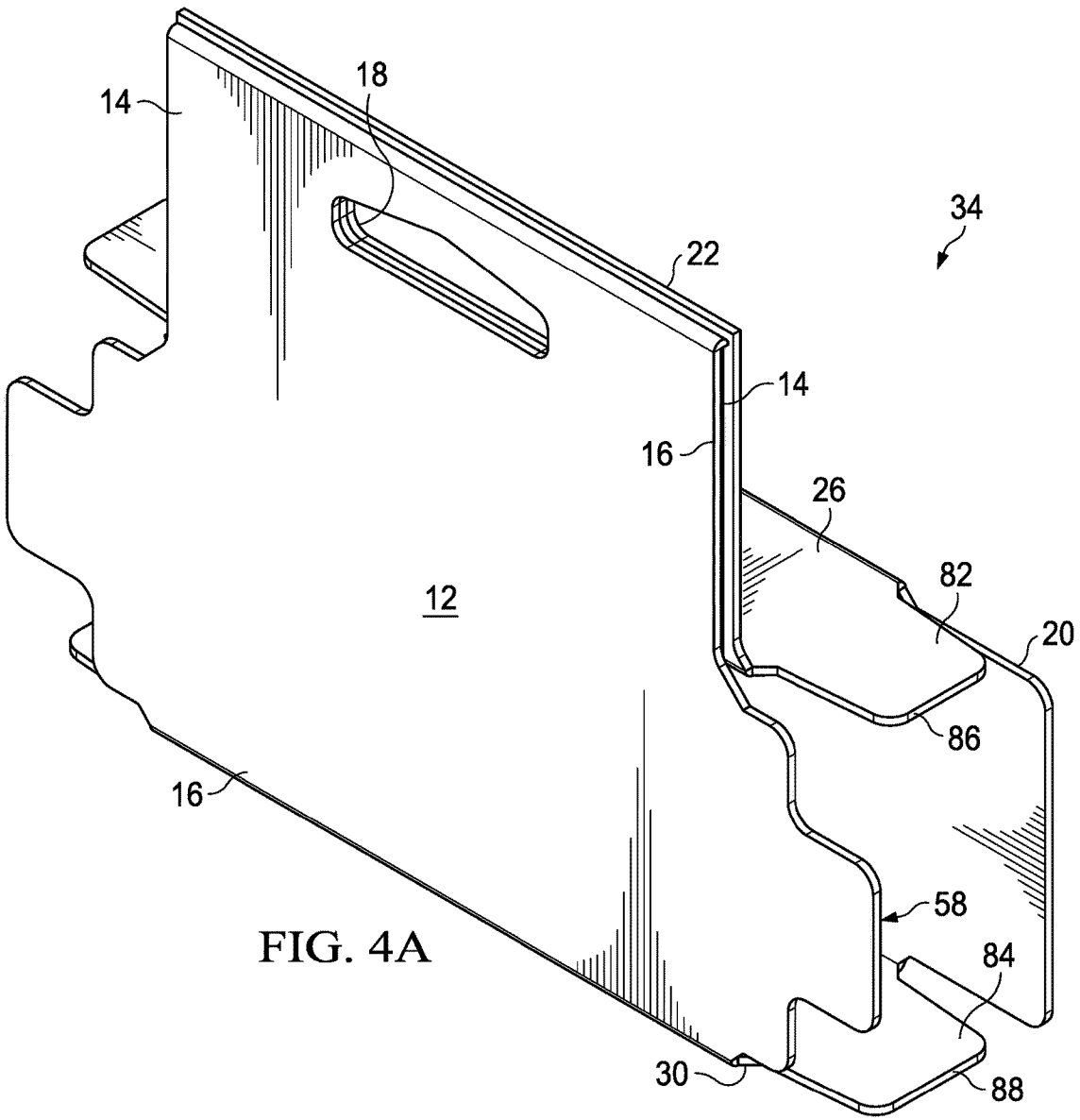
FIG. 4A is front perspective view of the sheet of formable material in a folded position.
Figure 4B:
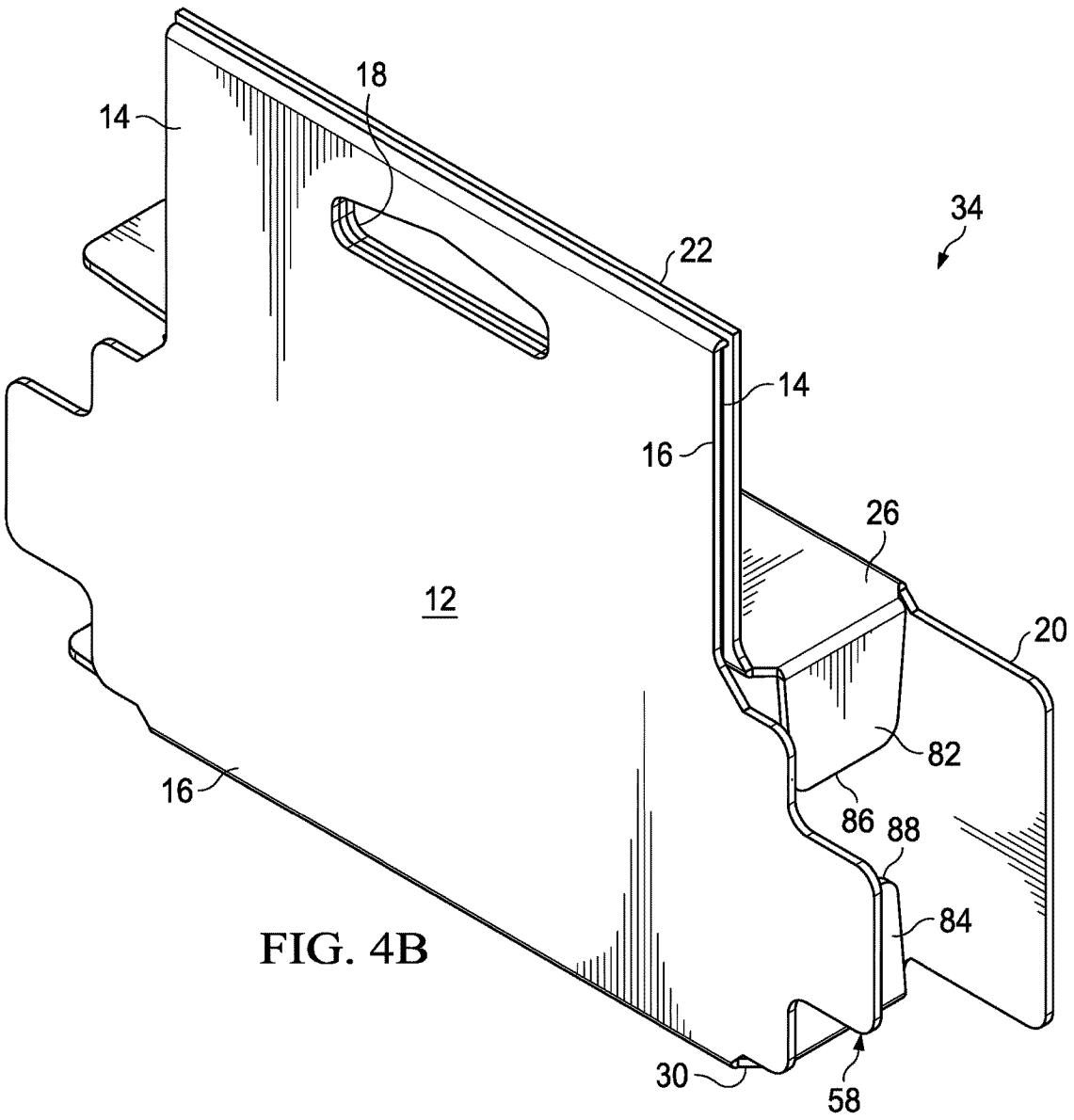
FIG. 4B is front perspective view of the sheet of formable material in a folded position.
Figure 4C:
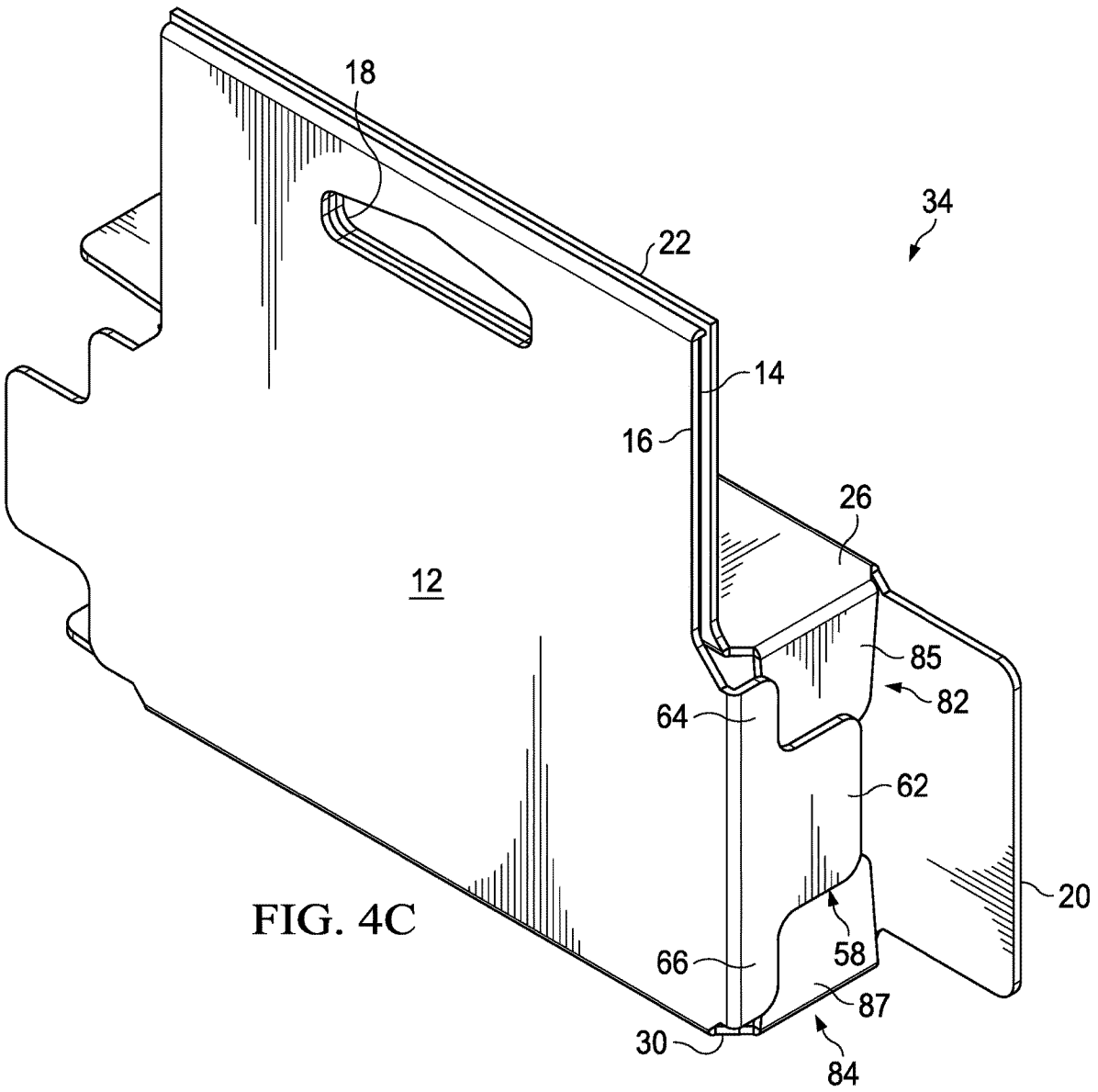
FIG. 4C is front perspective view of the sheet of formable material in a folded position.

A first upper minor tab 82 may extend from the top panel 26 and a first lower minor tab 84 may extend from the bottom panel 30. The first upper minor tab 82 and the first lower minor tab 84 may be positioned between the first side panel 20 and the first side support panel 58 after the front panel 12 is folded against the support panel 22. The first upper minor tab 82 and the first lower minor tab 84 may be folded, such that a respective edge 86 and 88 of the first upper minor tab 82 and the first lower minor tab 84 face each other (FIG. 4B). In the folded position, the first upper minor tab 82 and the first lower minor tab 84 may be transverse to the top panel 26 and the bottom panel 30, as shown in FIG. 4B. As shown in FIG. 4C, the first side support panel 58 may be folded over the first upper minor tab 82 and the first lower minor tab 84. In certain embodiments, the first side support panel 58 may be bonded to the first upper minor tab 82 and the first lower minor tab 84.

Figure 4D:
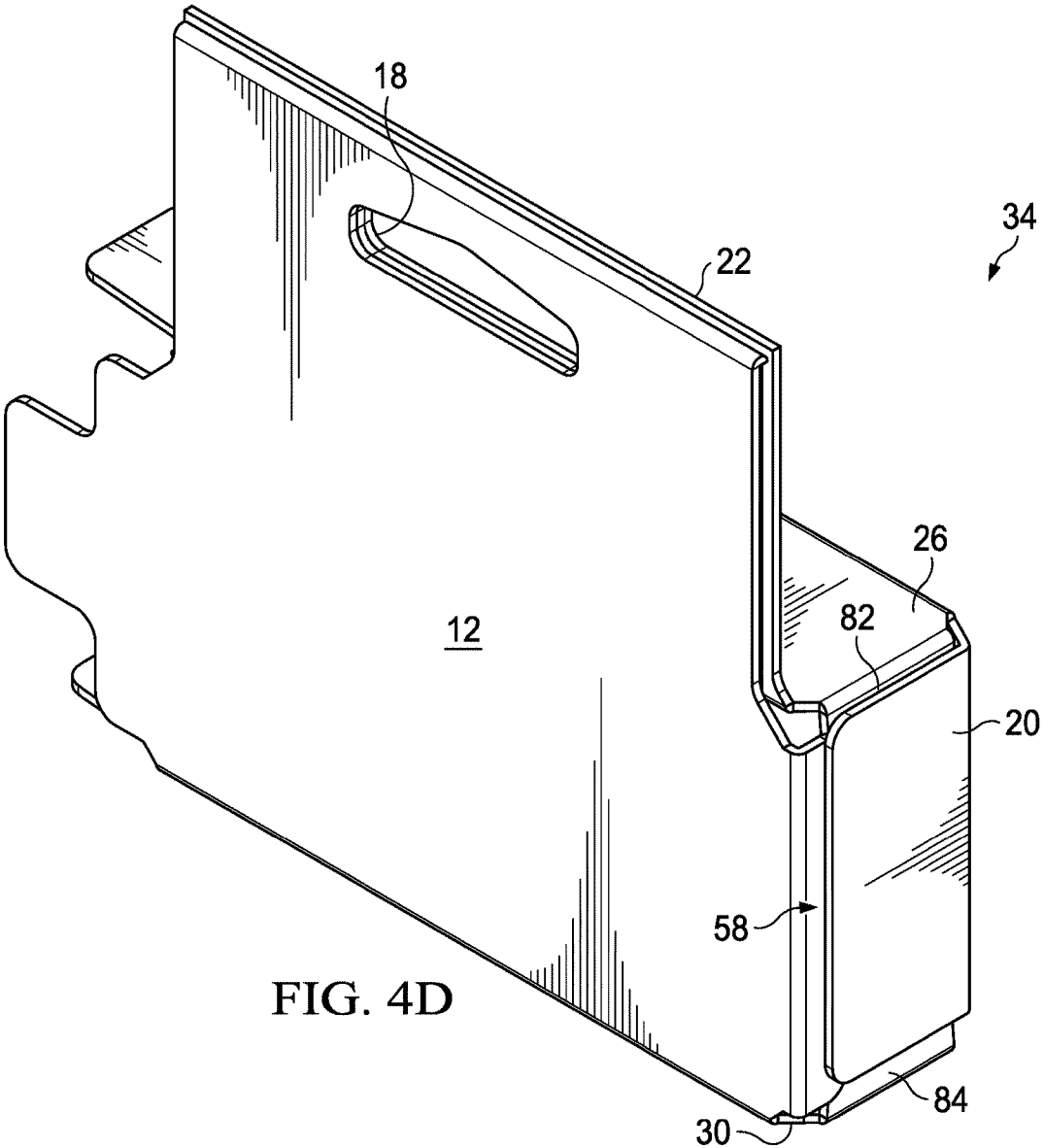
FIG. 4D is front perspective view of the sheet of formable material in a folded position.

As shown in FIGS. 4C and 4D, the first side panel 20 may be folded over the first side support panel 58, the first upper minor tab 82 and the first lower minor tab 84. The first side support panel 58 may cover only a portion of each of the first upper minor tab 82 and the first lower minor tab 84. For example, the first upper minor tab 82 may have an exposed portion 85 between the lateral portion 64 and the first side panel 20 (prior to folding of the first side panel 20 over the first side support panel 58). Similarly, the first lower minor tab 84 may have an exposed portion 87 between the lateral portion 66 and the first side panel 20 (prior to folding of the first side panel 20 over the first side support panel 58). The exposed portions 85 and 87 may allow the first side panel 20 to be sealed directly against both the first upper minor tab 82 and the first lower minor tab 84, not just the first side support panel 58. In certain embodiments, an adhesive may be applied between the exposed portions 85 and 87 and the first side panel 20. Adhesive may also be applied between the first side panel 20 and the first side support panel 58. The first side panel 20 may be bonded to the first side support panel 58 that extends from the front panel 12, the first upper minor tab 82 that extends from the top panel 26, and the first lower minor tab 84 that extends from the bottom panel 30. Accordingly, the first side panel 20 is reinforced by the front panel 12, the top panel 26 and the bottom panel 30. In certain embodiments, the first side panel 20 may be directly bonded to the central portion 62 of the first side support panel 58.

Figure 5A:
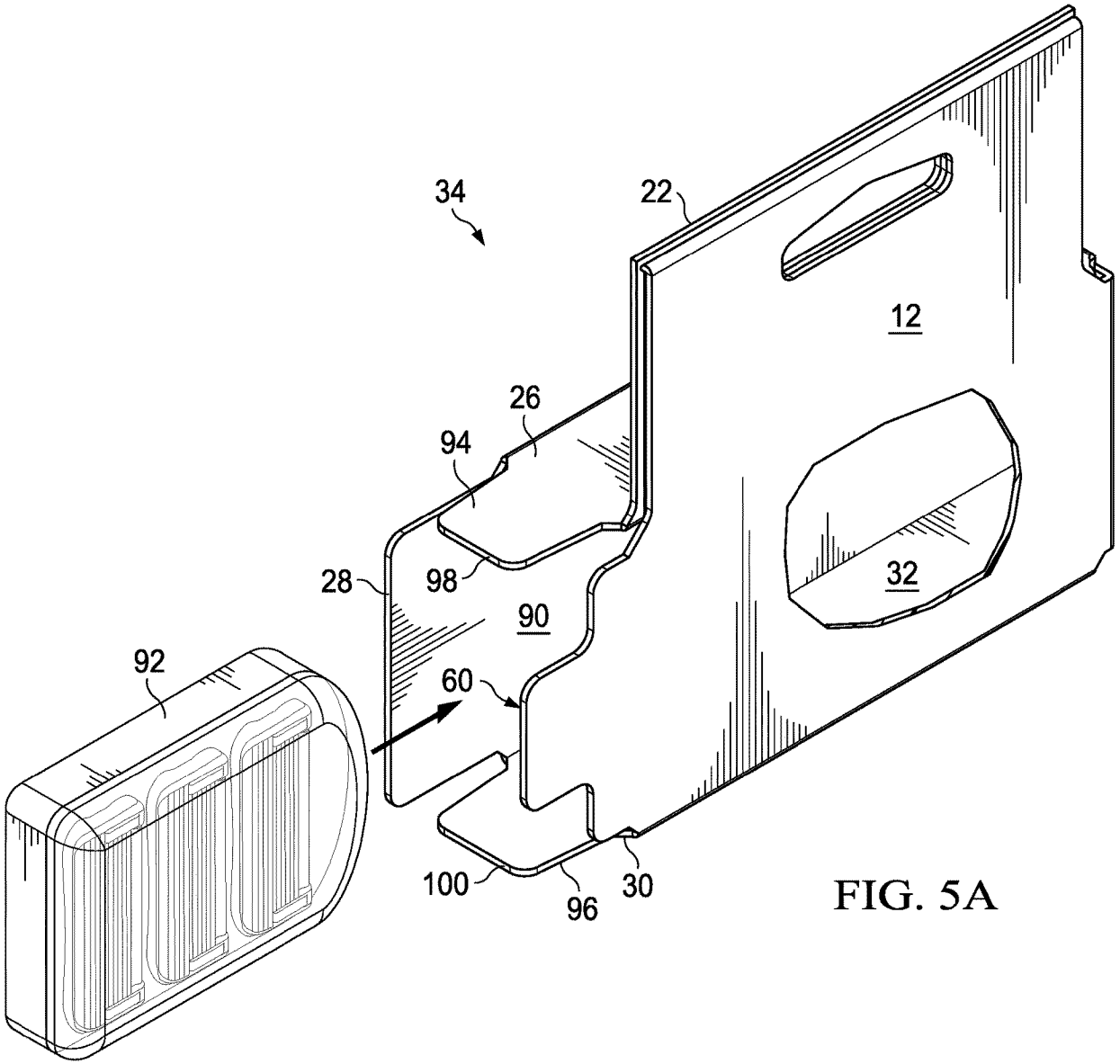
FIG. 5A is front perspective view of the sheet of formable material in a folded position with a consumer product.
Figure 5B:
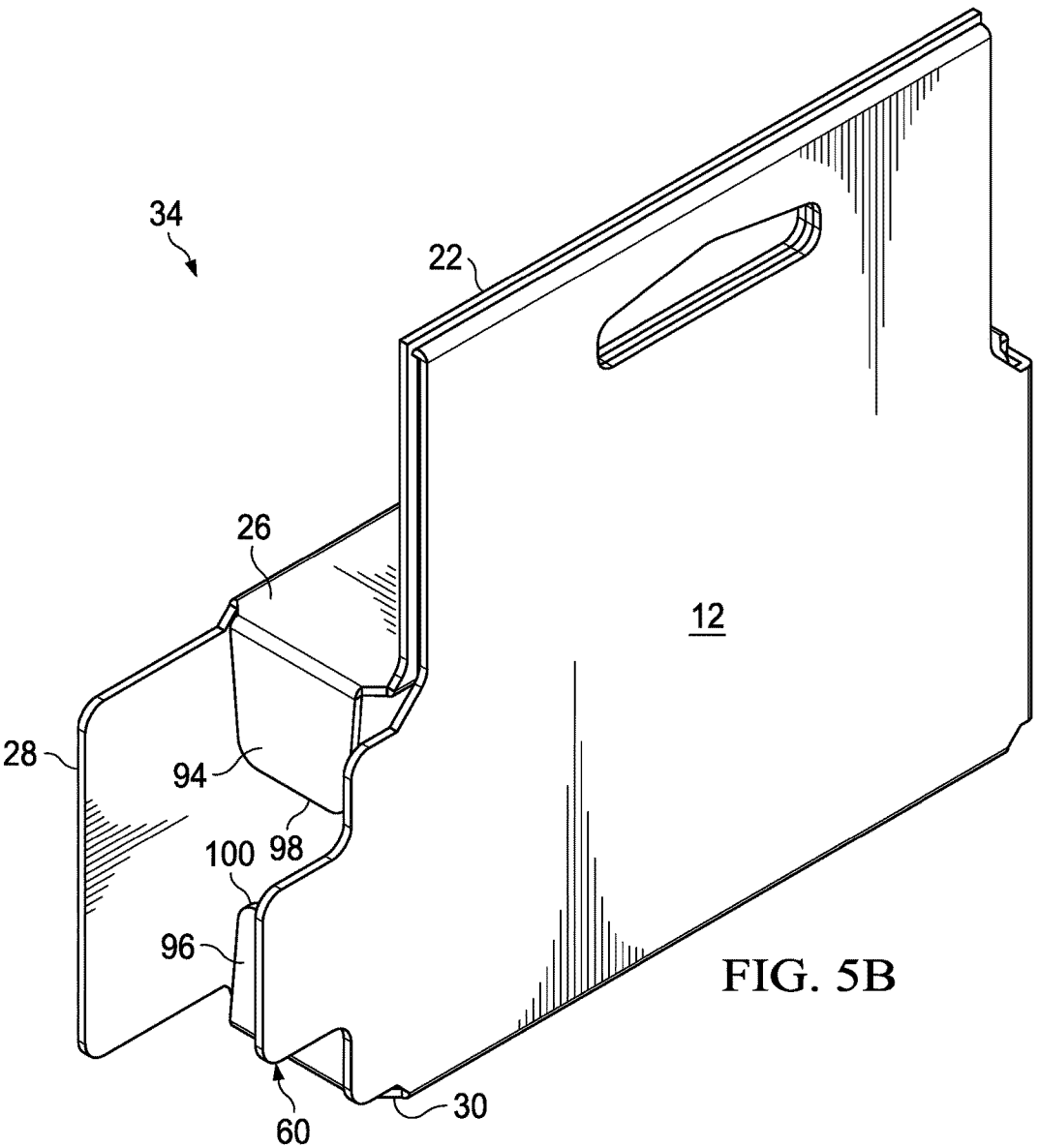
FIG. 5B is front perspective view of the sheet of formable material in a folded position.
Figure 5C:
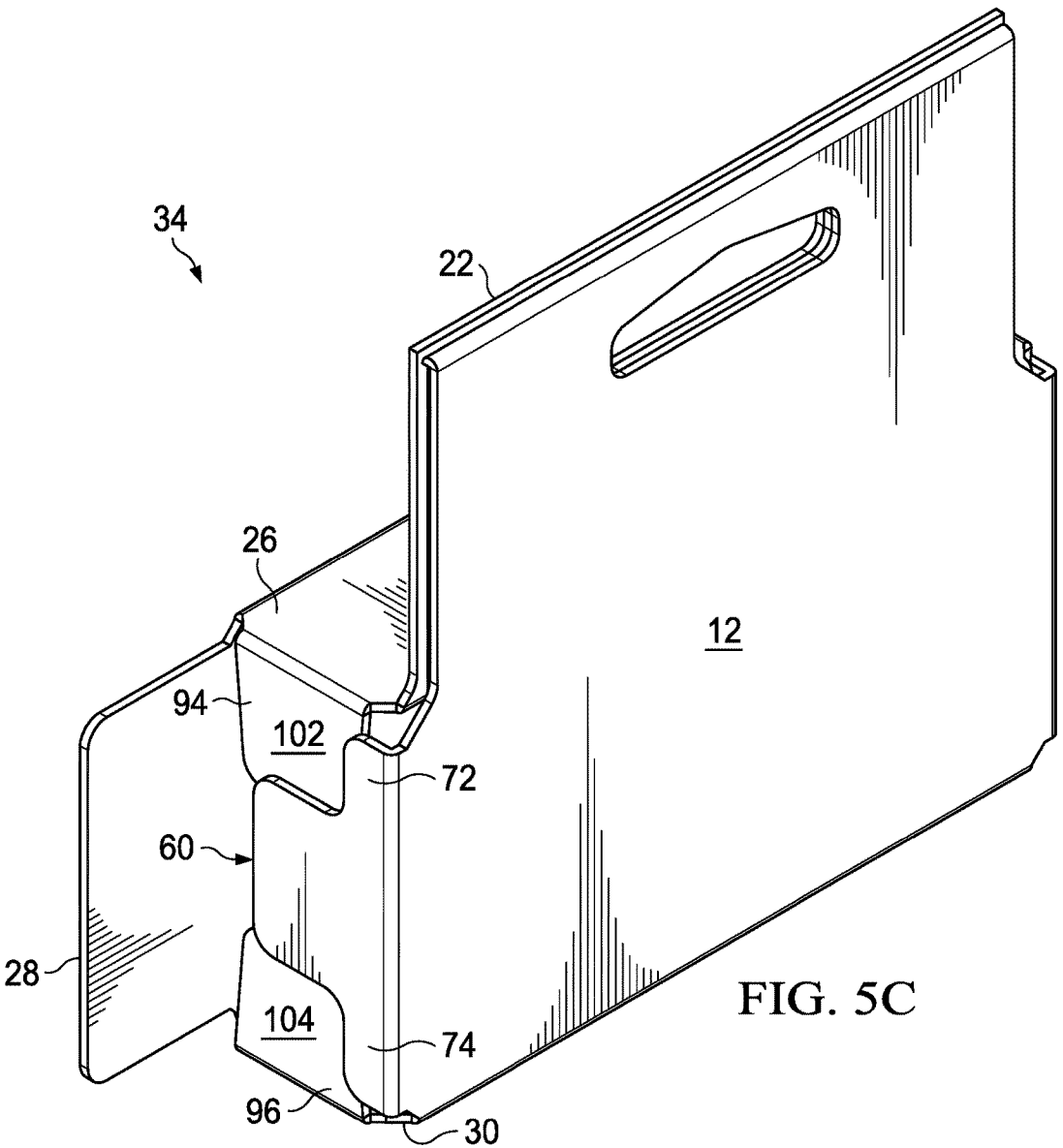
FIG. 5C is front perspective view of the sheet of formable material in a folded position.
Figure 5D:
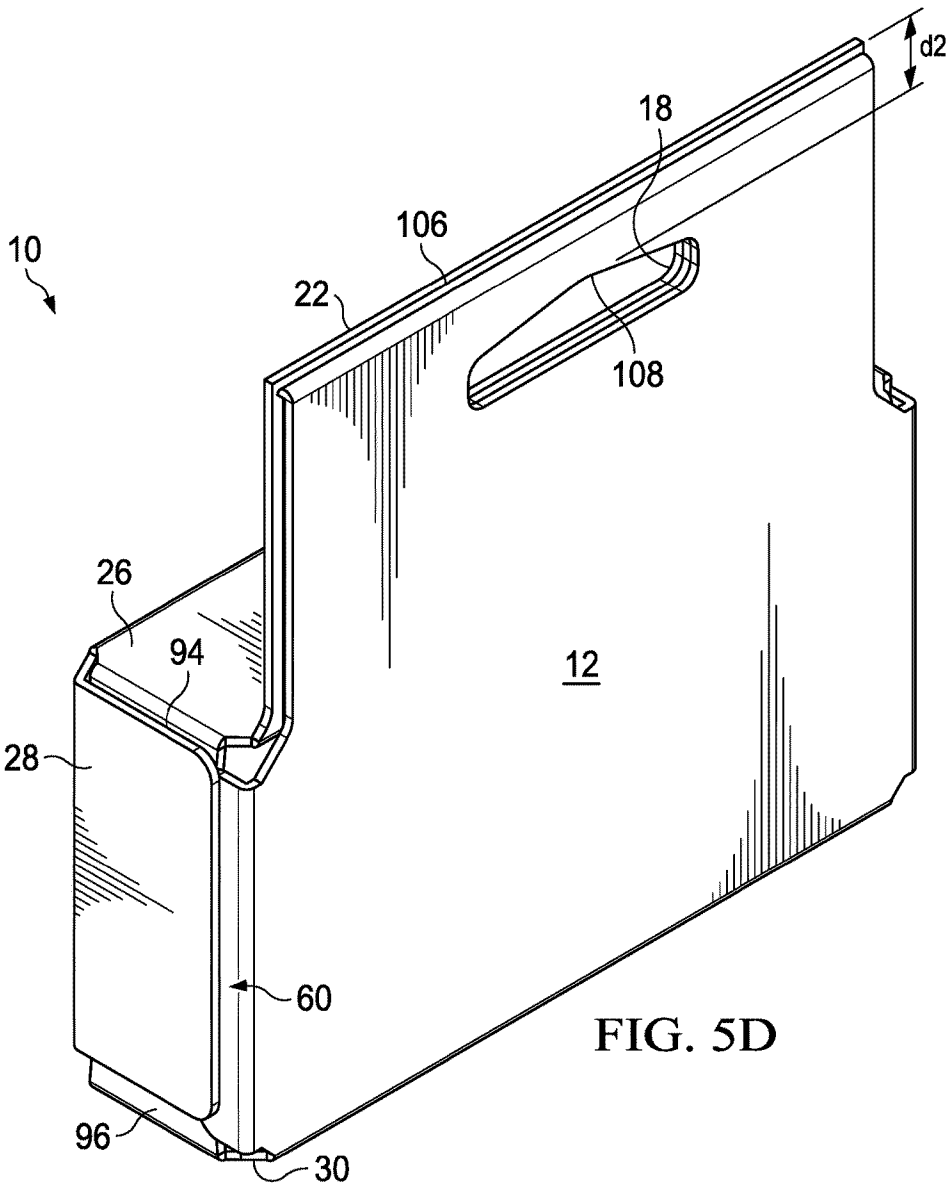
FIG. 5D is front perspective view of the sheet of formable material in a final folded position.

Referring to FIGS. 5A, 5B, 5C and 5D, perspective views of the sheet of formable material 34 are shown illustrating various folding steps to form the consumer product package 10 of FIGS. 1A and 1B. The sheet of formable material 34 may be folded to form an opening 90 in communication with the cavity 32. Accordingly, the opening 90 may be dimensioned to receive one or more consumer products 92, such as shaving razor cartridges that are positioned within the cavity 32 of the consumer product package 10 of FIGS. 1A and 1B. A second upper minor tab 94 may extend from the top panel 26 and a second lower minor tab 96 may extend from the bottom panel 30. The second upper minor tab 94 and the second lower minor tab 96 may be positioned between the second side panel 28 and the second side support panel 60 after the front panel 12 is folded against the support panel 22. The second upper minor tab 94 and the second lower minor tab 96 may be folded, such that a respective edge 98 and 100 of the second upper minor tab 94 and the second lower minor tab 96 face each other, as shown in FIG. 5B. In the folded position, the second upper minor tab 94 and the second lower minor tab 96 may be transverse to the top panel 26 and the bottom panel 30, as shown in FIG. 5B. The second side support panel 60 may be folded over the second upper minor tab 94 and the second lower minor tab 96. In certain embodiments, the second side support panel 60 may be bonded to the minor tabs 94 and 96.

As shown in FIG. 5D second side panel 28 may be folded over the second side support panel 60, the second upper minor tab 94 and the second lower minor tab 96. The second side support panel 60 may cover only a portion of each of the second upper minor tab 94 and the second lower minor tab 96. For example, the second upper minor tab 94 may have an exposed portion 102 between the lateral portion 72 and the second side panel 28, as shown in FIG. 5C (prior to folding of the second side panel 28 over the second side support panel 60). Similarly, the second lower minor tab 96 may have an exposed portion 104 between the lateral portion 74 and the second side panel 28 (prior to folding of the second side panel 28 over the second side support panel 60). The exposed portions 102 and 104 may allow the second side panel 28 to be sealed directly against both the second upper minor tab 94 and second lower minor tab 96, not just the first side support panel 58. In certain embodiments, an adhesive may be applied between the exposed portions 102 and 104 and the second side panel 28. Adhesive may also be applied between the second side panel 28 and the second side support panel 60. The second side panel 28 may be bonded to the second side support panel 60 that extends from the front panel 12, the second upper minor tab 94 that extends from the top panel 26 and the second lower minor tab 96 that extends from the bottom panel 30. Accordingly, the second side panel 28 is reinforced by the front panel 12, the top panel 26 and the bottom panel 30, which provides improved structural integrity of the consumer product package 10.

The consumer product package 10 may allow for more sustainable materials (e.g., plastic free) to be used for packaging containing consumer products that are often stolen from retailers. For example, shoplifters may either tear the consumer product package 10 in order to remove the consumer product or they may rip off a security tag attached to the opening 18. It is believed, without being held to theory, reinforcing the opening 18 may lose effectiveness if a distance d2 from an outer edge 106 of the consumer product package 108 to an inner edge 106 of the opening 18 is less than 5 mm. In certain embodiments, the distance d2 may be 5 mm to about 10 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be Fchammade without departing from the spirit and scope of the invention. It is therefore intended to cover in the appended claims all such changes and modifications that are within the scope of this invention.

What is claimed is:

1. A consumer product package comprising:

a front panel having an upper portion defining an opening and a lower portion defining an opening, the upper portion having a top surface folded over a top surface of the lower portion of the front panel with the opening of the upper portion aligned with the opening of the lower portion;

a rear panel parallel to the front panel;

a top panel extending between the front panel and the rear panel;

a bottom panel extending between the front panel and the rear panel;

a first side panel extending between the front panel and the rear panel and transverse to the top panel and the bottom panel;

a second side panel extending between the front panel and the rear panel and transverse to the top panel and the bottom panel;

a support panel extending from the top panel, the support panel defining an opening aligned with the opening of the lower portion and the opening of the upper portion, wherein the upper portion of the front panel is positioned between the lower portion of the front panel and the support panel, the front panel, the rear panel, the top panel, the bottom panel, the first side panel and the second side panel forming a cavity configured to receive a consumer product, wherein an edge of the upper portion of the front panel extends into the cavity.

2. The consumer product package of claim 1 wherein a distance from the bottom panel to an edge of the upper portion is at least 20% of a length (L1) of the front panel.

3. The consumer product package of claim 2 wherein the distance from the bottom panel to the edge of the upper portion position is about 20% to about 60% of the length of the front panel.

4. The consumer product package of claim 1 wherein the upper portion of the front panel is bonded to the lower portion of the front panel.

5. The consumer product package of claim 1 wherein a distance from an outer edge of the consumer product package to an inner edge of the opening is at least 5 mm.

* * * * *